US008292087B2

(12) United States Patent
Nagura

(10) Patent No.: US 8,292,087 B2
(45) **Date of Patent: *Oct. 23, 2012**

(54) BILL HANDLING MACHINE

(75) Inventor: Akihiro Nagura, Nagakute (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 241 days.

This patent is subject to a terminal disclaimer.

(21) Appl. No.: 12/350,288

(22) Filed: Jan. 8, 2009

(65) Prior Publication Data

US 2009/0120759 A1 May 14, 2009

Related U.S. Application Data

(63) Continuation of application No. 11/410,308, filed on Apr. 25, 2006, now Pat. No. 7,497,339.

(30) Foreign Application Priority Data

Jun. 15, 2005 (JP) ..... 2005-174492

(51) Int. Cl.
*B07C 5/00* (2006.01)

(52) U.S. Cl. ..... 209/534; 194/206

(58) Field of Classification Search ..... 209/534
See application file for complete search history.

(56) References Cited

U.S. PATENT DOCUMENTS

| | | | | |
|---|---|---|---|---|
| 6,719,120 | B2 * | 4/2004 | Kato | 194/206 |
| 6,722,486 | B2 * | 4/2004 | Shibata et al. | 194/206 |
| 6,896,114 | B1 * | 5/2005 | Matsumoto et al. | 194/202 |
| 7,422,118 | B2 * | 9/2008 | Ugo et al. | 209/534 |
| 2003/0173183 | A1 * | 9/2003 | Katou et al. | 194/206 |
| 2005/0056519 | A1 * | 3/2005 | Yokoi et al. | 194/206 |

FOREIGN PATENT DOCUMENTS

| | | |
|---|---|---|
| JP | 60-052465 | 3/1985 |
| JP | 07-057131 | 3/1995 |
| JP | 7-057131 | 3/1995 |
| JP | 7-282316 | 10/1995 |
| JP | 2000-99795 | 4/2000 |
| JP | 2004-013864 | 1/2004 |

OTHER PUBLICATIONS

Japanese Office Action issued in Japanese Patent Application No. JP 10-2006-0037128, mailed Apr. 4, 2007.

Japanese Office Action issued in Japanese Patent Application No. 2005-174492, dated Aug. 24, 2010.

Japanese Office Action issued in Japanese Patent Application No. 2005-174492, mailed Nov. 30, 2010.

* cited by examiner

*Primary Examiner* — Joseph C Rodriguez
*Assistant Examiner* — Kalyanavenkateshware Kumar
(74) *Attorney, Agent, or Firm* — McDermott Will & Emery LLP

(57) ABSTRACT

An object of the invention is to provide a bill handling machine in which a machine main body is made compact by moving a plate as occasion demands so as to adjust a space facing to a money input and output port, and a temporary storage portion temporarily storing a bill in a money input account is arranged near a first accommodating portion for the input bill sectionalized by the plate, in the bill handling machine.

10 Claims, 10 Drawing Sheets

BILL HANDLING MACHINE

INCORPORATION BY REFERENCE

This application is a Continuation of U.S. application Ser. No. 11/410,308, filed on Apr. 25, 2006 now U.S. Pat. No. 7,497,339, claiming priority of Japanese Application No. 2005-174492, filed Jun. 15, 2005, the entire contents of each of which are hereby incorporated by reference.

BACKGROUND OF THE INVENTION

1. Field of the Invention

The present invention relates to a bill handling machine which executes a money input account receiving a bill put in the machine and a money output account discharging the bill accommodated in the machine.

2. Description of Related Art

The bill handling machine such as an automatic teller machine (ATM), a cash dispenser (CD) or the like executing the money input account and the money output account is installed in a shop such as a financial institution, a convenience store or the like. The bill handling machine is structured such that an input and output bill accommodating space for accommodating the bill (the input and output bill) for the money input account and the money output account is formed in an inner side of a money input and output port, whereby the input and output of the bill is executed with respect to a user.

In particular, as a technique relating to the money input and output port, there is patent document 1 (JP-A-2000-99795). There is disclosed a structure in which a middle plate is provided in the input and output bill accommodating space facing to the money input and output port, and the input and output bill accommodating space is divided into an input bill space in which the input bill is put and a discharge bill space accommodating a reject bill and the output bill, by the middle plate, and there is disclosed a structure in which magnitudes of the spaces are adjusted as occasion demands by moving the middle plate. The bill handling machine can directly feed the reject bill to the discharge bill space at a time of the money input account so as to accommodate the bill, and it is not necessary to form a reject bill accommodating portion in a machine main body. Accordingly, it is possible to make the machine main body compact.

BRIEF SUMMARY OF THE INVENTION

However, in the bill handling machine shown in the patent document 1, since it is necessary to form a temporary storage portion temporarily storing the bill judged as a receivable bill at a time of the money input account until the user confirms the input money amount separately from the input and output bill accommodating space and in an isolating manner within the machine, the machine is not made sufficiently compact.

An object of the present invention is to provide a bill handling machine which can make the machine further compact, while paying attention particularly to the money input and output port and the temporary storage portion.

Further, an object of the present invention is to provide the machine having an excellent operability with respect to taking out the bill in the money input and output port.

In order to achieve the object mentioned above, the bill handling machine in accordance with the present invention is particularly characterized by a structure in which a temporary storage portion is arranged near a money input and output port. Further, the present invention employs a structure in which the temporary storage portion is used both as accumulation of the output bill. In other words, the present invention employs a structure in which an accommodating space in an inner portion of the money input and output port is divided into an input bill accommodating portion and a temporary storage portion at a time of inputting the money.

Since it is possible to adjust a space facing to the money input and output port by divisionally forming first to third bill accommodating spaces comprising an input bill putting space at a time of the money input account, a reject bill accommodating space accommodating the reject bill and a temporary storage space accommodating the received bill, moving three pusher plates (pressure plates or push plates) and adjusting positions of the pusher plates, it is possible to make the machine main body compact.

Further, it is possible to achieve a security property and an improved operability on the basis of a shape of the pusher plates forming the temporary storage portion.

Other objects, features and advantages of the invention will become apparent from the following description of the embodiments of the invention taken in conjunction with the accompanying drawings.

BRIEF DESCRIPTION OF THE SEVERAL VIEWS OF DRAWING

Figure 11:
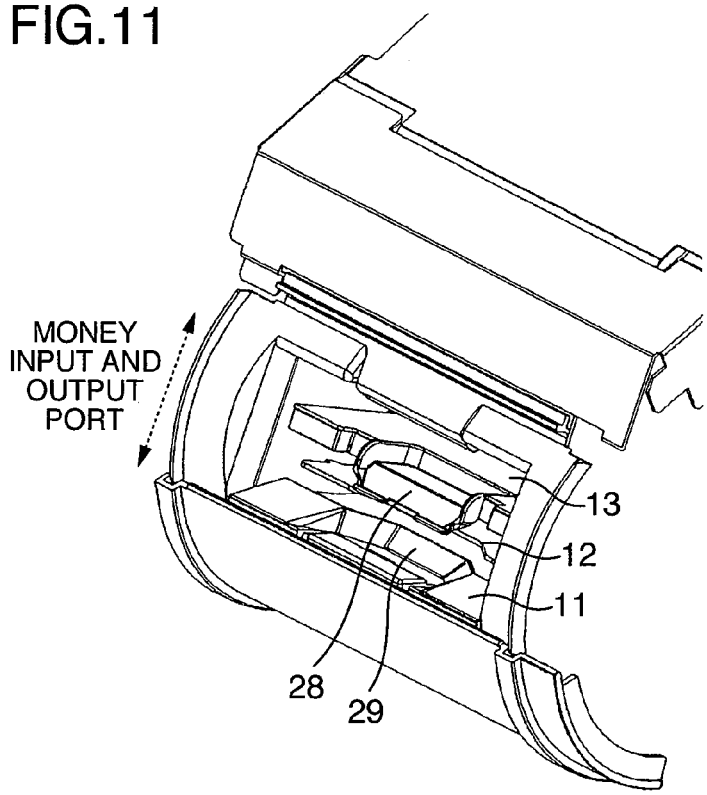

FIG. 11 is a perspective view of plates 11, 12 and 13 at a time of being seen by opening a shutter 2*a;*

Figure 12:
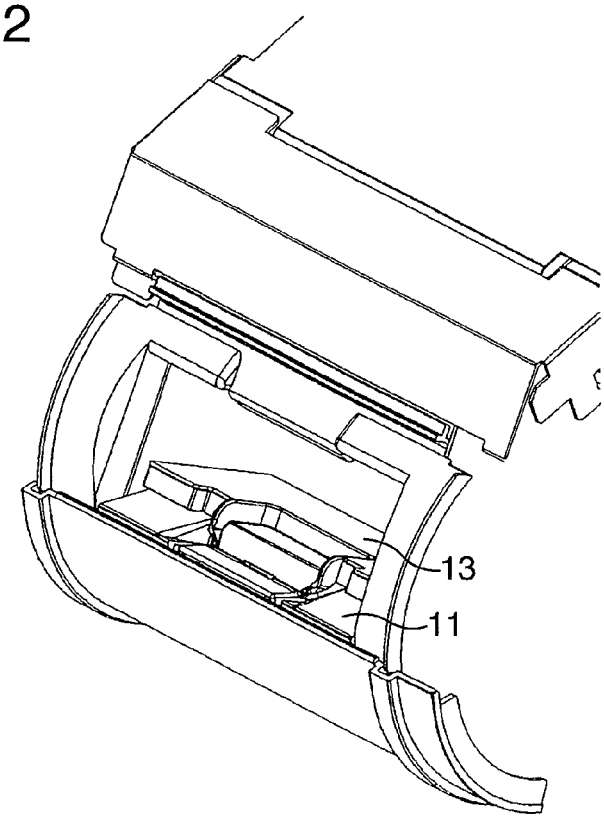

FIG. 12 is a perspective view showing a state in which the plate 13 is brought into contact with the plate 11 by opening the shutter 2*a;*

Figure 13:
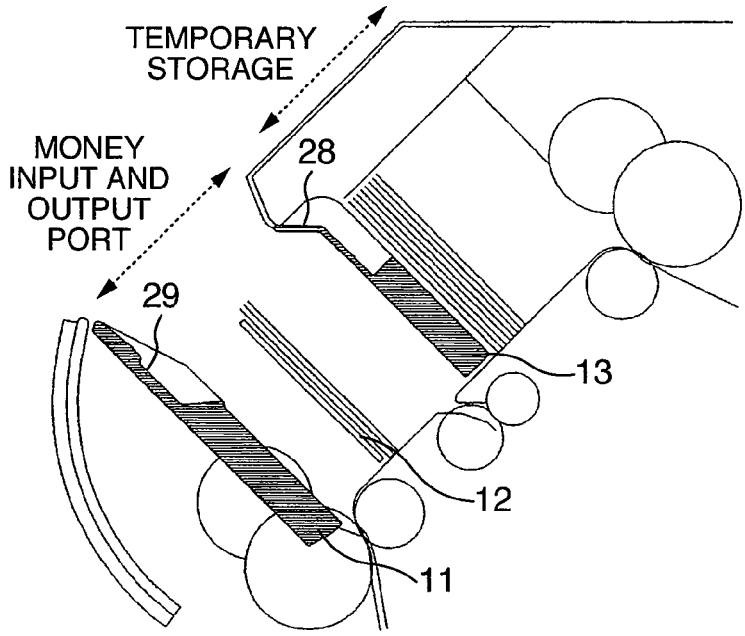
Figure 14:
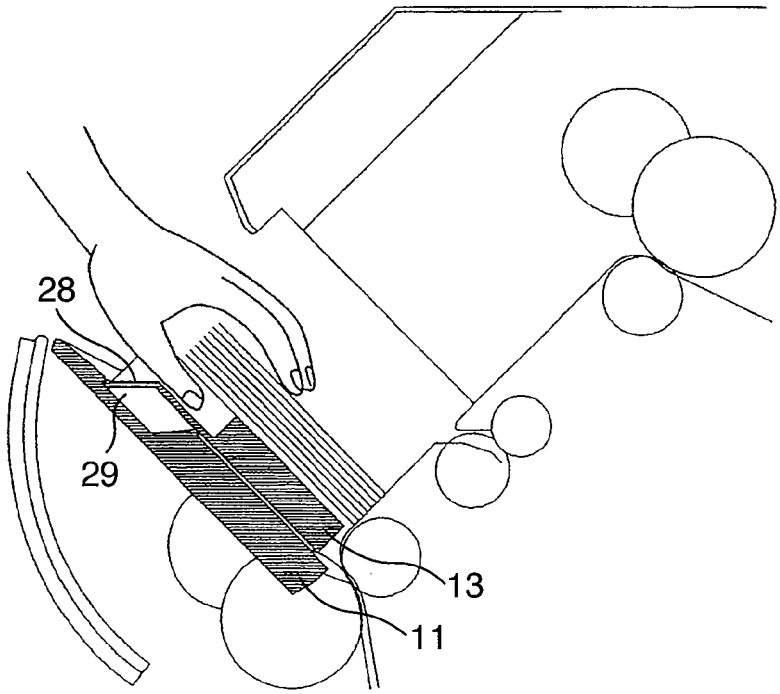
Figure 15:
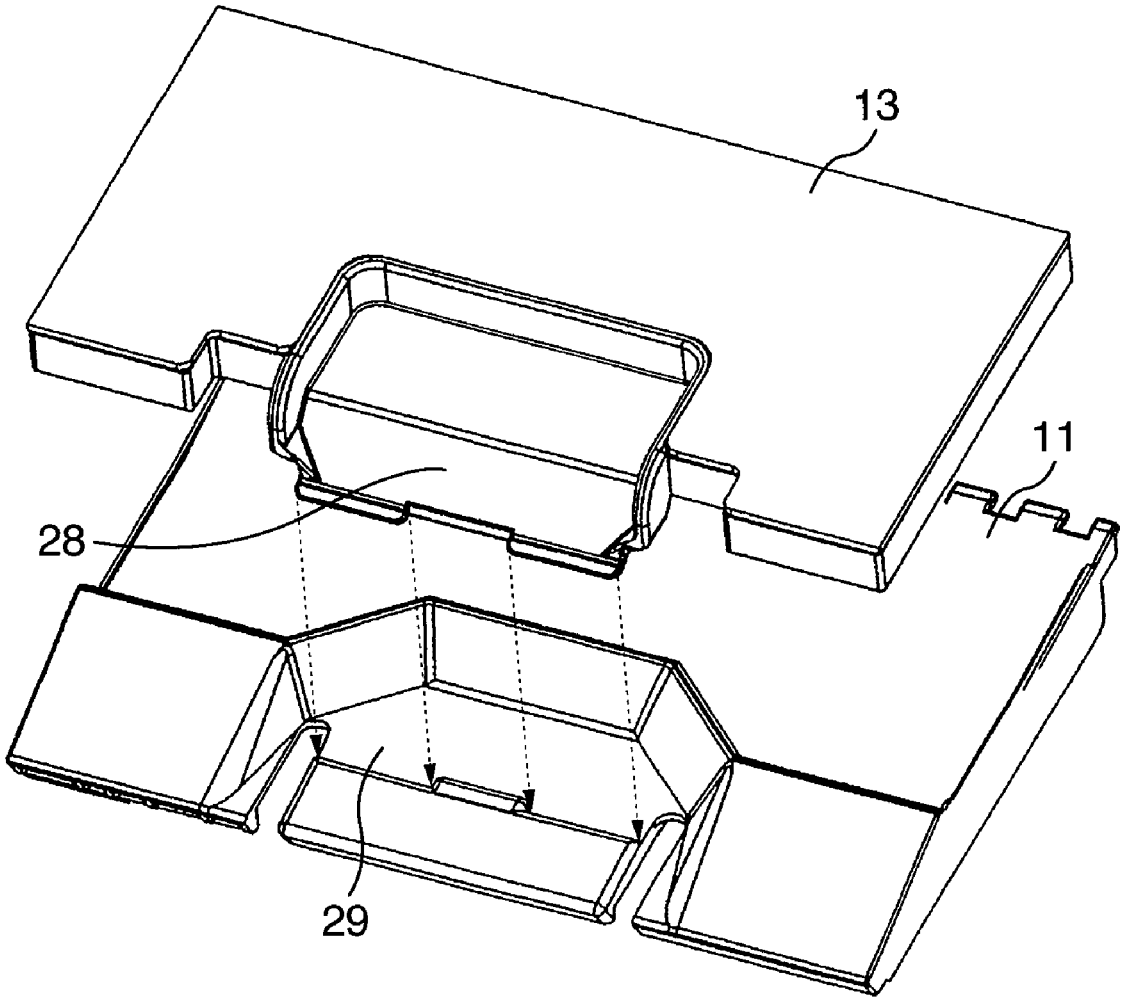

FIG. 13 is a view showing a positional relation of the plates at a time when a reject is generated at a time of the money input account;

FIG. 14 is a view showing a positional relation of the plates at a time of returning a bill in the case of the money input account or at a time of outputting the bill in the case of the money output account; and FIG. 15 is a view showing a positional relation at a time when the receiving plate 11 and the second pusher plate are brought into contact with each other.

DETAILED DESCRIPTION OF THE INVENTION

Figure 1:
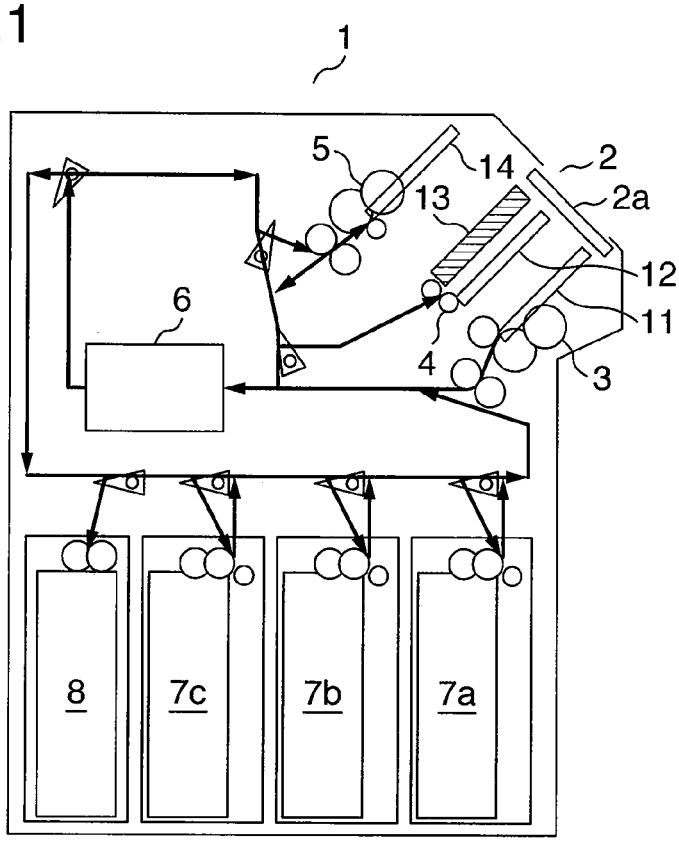
FIG. 1 is a view showing a structure of a main portion of a bill handling machine.

A description will be given below of a bill handling machine in accordance an embodiment of the present invention. FIG. 1 shows an outline cross sectional view of a structure of a main portion of a bill handling machine. A bill handling machine 1 has a function that a money input account and a money output account execute by a control portion controlling an entire of the machine, and is called as an automatic teller machine (ATM) together with a card mechanism portion handling a card, an operation portion operated by a customer and the like. A money input and output port 2 for the bill is formed in a front face of the main body. A shutter 2*a* is provided in the money input and output port 2. A receiving plate 11, a first pusher plate 12 (which may be called as a plate simply, and so on), a second pusher plate 13 and a third pusher plate 14 are provided in a rising manner in an inner side of the machine facing to the money input and output port 2 in this order from a lower end side of the money input and output port 2. The receiving plate 11 is provided in rising manner such that one end is along a lower end line of the money input and output port 2. The receiving plate 11 is fixed. On the other hand, the first pusher plate 12, the second pusher plate 13 and the third pusher plate 14 are attached so as to be movable in a direction of moving close to and apart from the receiving plate 11.

Further, reference numeral 3 denotes a separating and feeding mechanism including a feeding roller feeding the bill accommodated between the receiving plate 11 and the first pusher plate 12. Reference numeral 4 denotes a stack mechanism including a carrying roller carrying and accommodating the bill between the first pusher plate 12 and the second pusher plate 13. Reference numeral 5 denotes a separating and feeding/stack mechanism including a feeding roller feeding the bill accommodated between the second pusher plate 13 and the third pusher plate 14, and a carrying roller carrying the bill to the portion between them. There is established a state in which one end portion of the first pusher plate 12 is provided in a rising manner along an upper end line of the money input and output port 2, the second pusher plate 13 is brought into contact with the first pusher plate 12, and the third pusher plate 14 is provided in a rising manner at a position which is at an approximately equal width to the money input and output port 2 apart from the second pusher plate 13. This state is called as an initial state (a state in which the first to third pusher plates 12 to 14 exist at an initial position). In this case, although details will be mentioned later, an interval between the second pusher plate 13 and the third pusher plate 14 is approximately equal to the width of the money input and output port 2 to the maximum.

The stack mechanism 4 can feed the bill to the portion between the first pusher plate 12 and the second pusher plate 13, at a time when the second pusher plate 13 exists at the initial position. Further, the separating and feeding/stack mechanism 5 can carry the bill to the portion between the second pusher plate 13 and the third pusher plate 14, at a time when the third pusher plate 14 exists at the initial position, and can feed the bill brought into contact with the third pusher plate 14 one by one.

The receiving plate 11 forms a notch at a position to which the feeding roller or the separating and feeding mechanism 3 faces, and is structured such that the bill accommodated in the bill accommodating space between the receiving plate 11 and the first pusher plate 12 is brought into contact with the feeding roller. Further, a notch is formed at a position to which the feeding roller of the separating and feeding mechanism 3 faces, in the first pusher plate 12, and the first pusher plate 12 is structured such that the bill accommodated in the bill accommodating space between the first pusher plate 12 and the second pusher plate 13 is brought into contact with the feeding roller. Accordingly, it is possible to feed the bill accommodated in the bill accommodating space between the receiving plate 11 and the first pusher plate 12, and in the bill accommodating space between the first pusher plate 12 and the second pusher plate 13, one by one, by the feeding roller of the separating and feeding mechanism 3.

Further, the third pusher plate 14 is structured such that a notch is formed at a position to which the feeding roller of the separating and feeding/stack mechanism 5 faces, and the bill accommodated in the bill accommodating space between the second pusher plate 13 and the third pusher plate 14 is brought into contact with the feeding roller. Accordingly, it is possible to feed the bill accommodated in the bill accommodating space between the second pusher plate 13 and the third pusher plate 14, one by one, by the feeding roller of the separating and feeding/stack mechanism 5.

Further, reference numeral 6 shown in FIG. 1 denotes a judging portion judging wither or not the bill corresponds to a receivable bill, by judging truth and kind of the bill, reference symbols 7*a* to 7*c* denote a bill cartridge (a bill kind box) provided per the bill kind, and reference numeral 8 denotes a recovery cartridge (a recovery box) recovering the bill which is neglected to be taken. The receivable bill corresponds to a bill which is true and of a kind handled by the bill handling machine 1. For example, even if the bill is judged as the true bill, the bill of the kind which is not handled is judged that the bill is not the receivable bill. A bill accommodating space (a first bill accommodating space (a first bill accommodating portion)) between the receiving plate 11 and the first pusher plate 12 is used as a space in which the bill is put at a time of the money input account. A bill accommodating space (a second bill accommodating space (a second bill accommodating portion)) between the first pusher plate 12 and the second pusher plate 13 is used as a space in which the reject bill (the bill judged by the judging portion 6 that it is not the receivable bill) is accommodated at a time of the money input account. Further, a bill accommodating space (a third bill accommodating space (a third bill accommodating space (a third bill accommodating portion)) between the second pusher plate 13 and the third pusher plate 14 is used as a temporary storage space which temporarily stores the receivable bill (the bill judged by the judging portion 6 that it is the receivable bill) at a time of the money input account, and an accommodating space which accommodates the output bill (the bill fed out from the bill cartridges 7*a* to 7*c*) at a time of the money output account. It is possible to adjust sizes (a distance between two facing plates) and positions of the bill accommodating spaces, by moving the first to third pusher plates 12 to 14 and adjusting the positions of the pusher plates 12 to 14.

A bill carrier path is formed in the bill handling machine 1. The bill carrier path carries the bill fed from the bill accommodating space between the receiving plate 11 and the first pusher plate 12 to the bill accommodating space between the first pusher plate 12 and the second pusher plate 13 or the bill accommodating space between the second pusher plate 13 and the third pusher plate 14, via the judging portion 6, carries the bill fed from the bill accommodating space between the second pusher plate 13 and the third pusher plate 14 to the bill cartridges 7*a* to 7*c* or the recovery cartridge 8, via the judging portion 6, and carries the bill fed from the bill cartridges 7*a* to 7*c* to the bill accommodating space between the second pusher plate 13 and the third pusher plate 14, via the judging portion 6. The bill carrier path is provided with a flapper switching the carrier path of the bill in correspondence to the destination of the fed bill.

As mentioned above, a particular feature exists in the structure in which the temporary storage portion (the third bill accommodating space) judging the input bill by the judging portion 6 and thereafter storing the bill temporarily until the counted bill is confirmed by the customer is provided near the bill input and output port 2. Further, the third bill accommodating space is used both as the accommodating space used at a time of outputting the bill. Further, with respect to the accommodation of the input bill generated in the money output account, the accommodation of the reject bill at a time of the money input, the accommodation of the bill temporarily stored at a time of the money input, and the accommodation of the bill at a time of the money output, the machine can be made compact by arranging them near the money input and output port 2.

Figure 2:
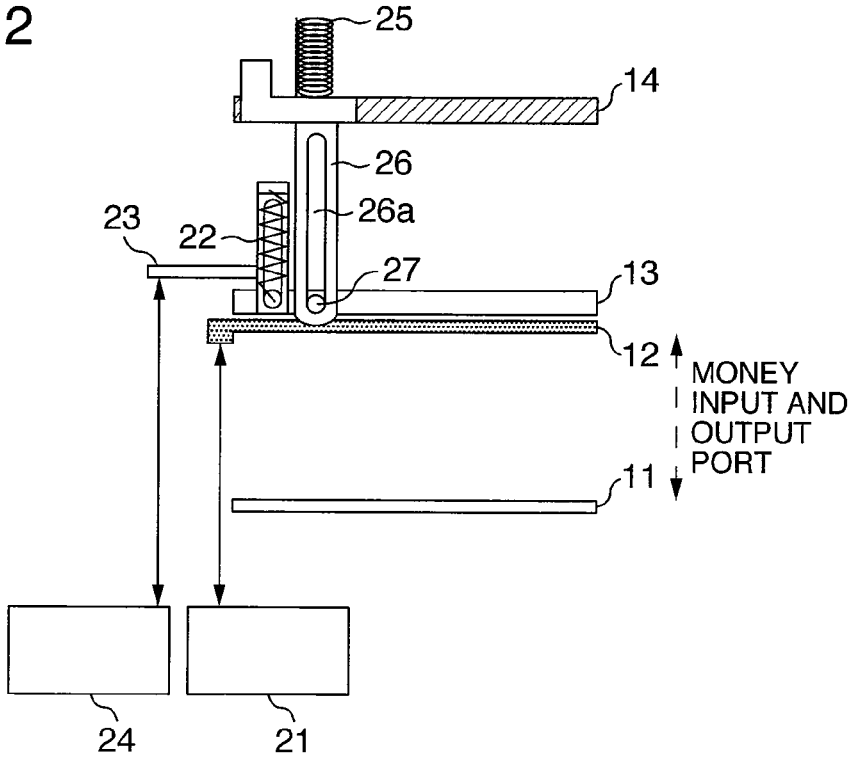
FIG. 2 is a schematic view showing an attachment of a receiving plate and first to third pusher plates.

FIG. 2 is a schematic view showing an attached state of the receiving plate and the first to third pusher plates. FIG. 2 shows a state in which the first to third pusher plates exist at the initial position. The receiving plate 11 is provided in a rising manner such that one end portion is along a lower end line of the money input and output port 2. The receiving plate 11 is fixed in such a manner as mentioned above, and does not move. The first pusher plate 12 is attached in such a manner as to be movable between a position where the first pusher plate 12 is brought into contact with the receiving plate 11 and a position where one end portion is approximately along an upper end line of the money input and output port 2. The first pusher plate 12 is moved in a direction of moving close to and apart from the receiving plate 11 by a first actuator 21. A width of the bill accommodating space between the receiving plate 11 and the first pusher plate 12 becomes maximum at a time when the first pusher plate 12 exists at the initial position, and is approximately equal to the width of the money input and output port 2. On the contrary, it becomes minimum at a time when the first pusher plate 12 exists at a position where the first pusher plate 12 is brought into contact with the receiving plate 11, and the width is approximately 0. When the first pusher plate 12 exists at the initial position, the bill accommodating space between the receiving plate 11 and the first pusher plate 12 faces to the money input and output port 2.

The second pusher plate 13 is coupled to a drive plate 23 via a first spring 22. The drive plate 23 is moved in a vertical direction (a direction moving close to and apart from the receiving plate 11) by a second actuator 24. The second pusher plate 13 can be moved to the first pusher plate 12 side by moving the drive plate 23 to the first pusher plate 12 side. The second pusher plate 13 does not move to a lower side than a position where the second pusher plate 13 is brought into contact with the pusher plate 12. When the first pusher plate 12 exists at a position where the first pusher plate 12 is brought into contact with the receiving plate 11, and the second pusher plate 13 exists at the original position, a bill accommodating space between the first pusher plate 12 and the second pusher plate 13 faces to the money input and output port 2.

Further, the third pusher plate 14 is energized in a direction moving apart from the second pusher plate 13 by a second spring 25. The third pusher plate 14 is coupled to the second pusher plate 13 by a coupling plate 26 in which an oblong hole 26*a* is formed. Specifically, as shown in FIG. 2, the second pusher plate 13 and the third pusher plate 14 are coupled by attaching the coupling plate 26 to a side surface of the third pusher plate 14 and inserting a convex portion 27 provided in a side surface of the second pusher plate 13 to the oblong hole of the coupling plate 26. The third pusher plate 14 is in a state of being moved to the highest at a position shown in FIG. 2, is brought into contact with a stopper (not shown) in this state, and does not move to the higher. At this time, the convex portion 27 is brought into contact with an end portion in a lower side of the oblong hole 26*a*.

The second pusher plate 13 can move upward to a position where the second pusher plate 13 is brought into contact with the third pusher plate 14 which is brought into contact with the stopper (not shown) so as to stop. Further, when further moving the drive plate 23 downward by the second actuator 24 in a state in which the convex portion 27 provided in the side surface of the second pusher plate 13 is brought into contact with the lower end of the oblong hole 26*a* of the coupling plate 26, the third pusher plate 14 moved downward in accordance with the downward movement of the second pusher plate 13. When the first pusher plate 12 exists at the position where the first pusher plate 12 is brought into contact with the receiving plate 11, and the second pusher plate 13 exists at the position where the second pusher plate 13 is brought into contact with the first pusher plate 12, the position of the third pusher plate 14 corresponds to a position where one end portion is along an upper end line of the money input and output port 2. At this time, the bill receiving space between the second pusher plate 13 and the third pusher plate 14 faces to the money input and output port 2.

As mentioned above, it is possible to make any one of three bill accommodating spaces face to the money input and output port 2 by moving the first to third pusher plates 12 to 14 by two drive portions of the first actuator 21 and the second actuator 24 and adjusting the positions of the pusher plates 12 to 14.

A description will be given below of an operation at a time of the money input account and an operation at a time of the money output account in the bill handling machine 1 in accordance with the embodiment. First, a description will be given of the operation at a time of the money input account. In this case, the description of the process applied to a passbook and a card in the bill handling machine 1 will be omitted.

Figure 3:
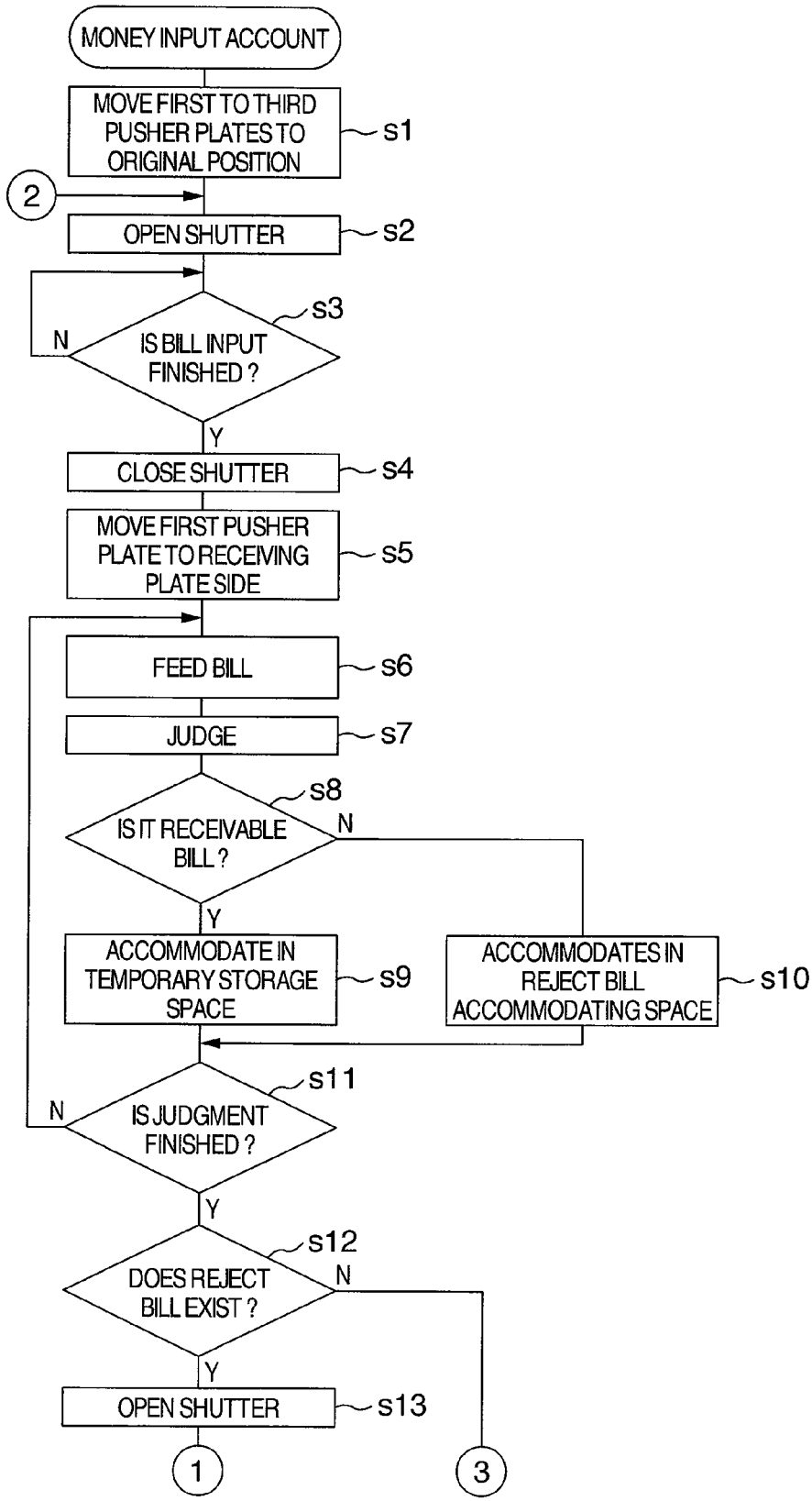
FIG. 3 is a flow chart showing a process at a time of money input account.
Figure 4:
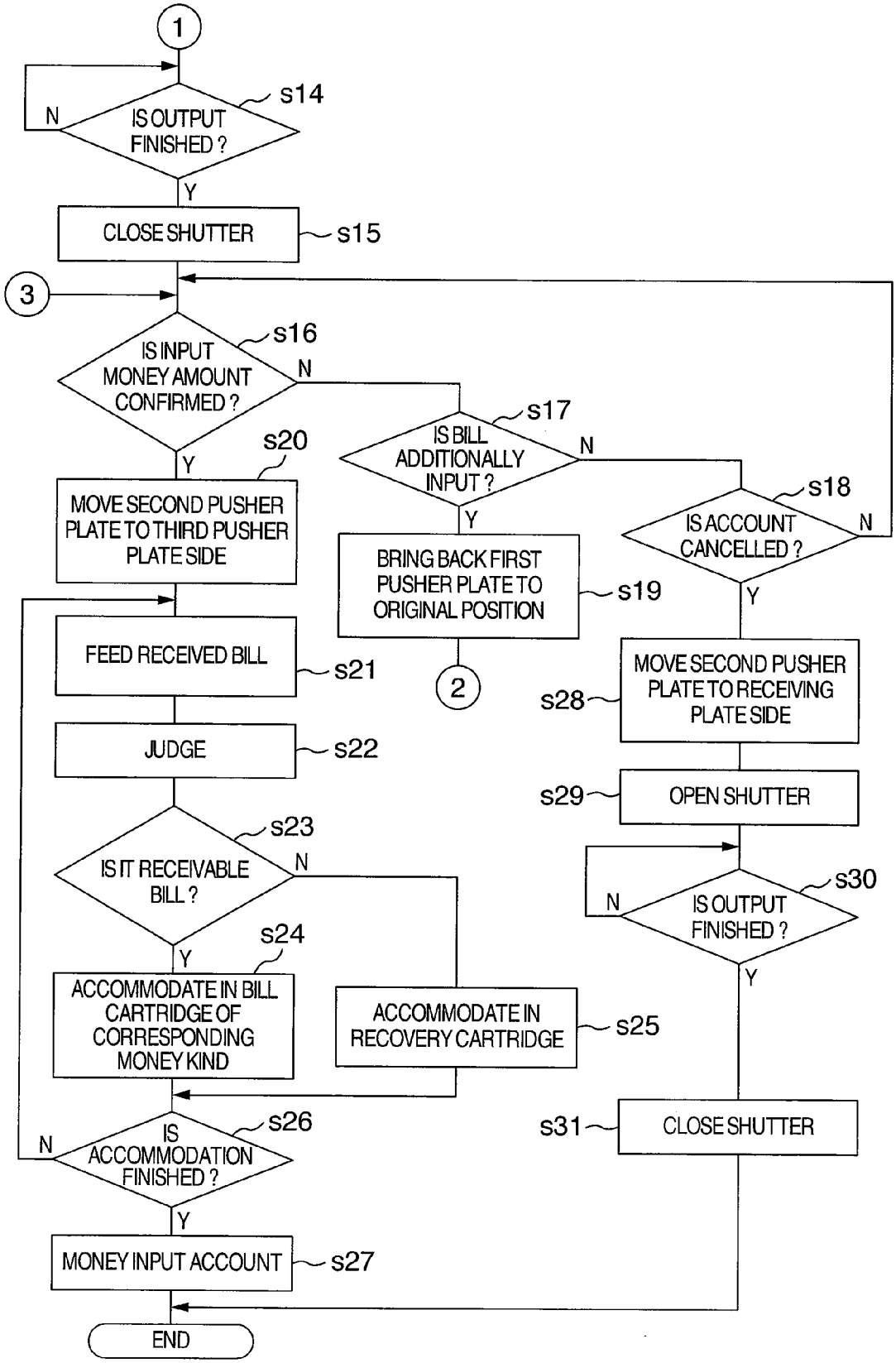
FIG. 4 is a flow chart showing a process at a time of money input account.

FIGS. 3 and 4 are flow charts showing a process at a time of the money input account in the bill handling machine in accordance with the embodiment. If the money input account is selected, the bill handling machine 1 starts the process. The bill handling machine 1 moves the first to third pusher plates 12 to 14 to the original position (s1).

As mentioned above, when the first to third pusher plates 12 to 14 exist at the original position, a bill accommodating space (hereinafter, refer to a bill input space) between the receiving plate 11 and the first pusher plate 12 faces to the money input and output port 2. The bill handling machine 1 opens the shutter 2*a* (s2), and waits for the bill input to the bill input space (s3). If the bill is input to the bill input space, the bill handling machine 1 closes the shutter 2*a* (s4), moves the first pusher plate 12 to the receiving plate 11 side, and presses the bill input to the bill input space to the feeding roller of the separating and feeding mechanism 3 (s5) (refer to FIG. 5). As mentioned above, it is possible to press the bill input to the bill input space to the third feeding roller of the separating and feeding mechanism 3 by the first pusher plate 12 on the basis of a suitable pressing force.

The bill handling machine 1 feeds the bills input to the bill input space one by one by rotating the feeding roller of the separating and feeding mechanism 3 (s6), and carries the fed bill to the judging portion 6. Further, the bill handling machine 1 judges in the judging portion 6 whether or not the bill is receivable (s7). The bill handling machine 1 carries the bill judged as the receivable bill in the judging portion 6 to a bill accommodating space (hereinafter, refer to as a temporary storage space) between the second pusher plate 13 and the third pusher plate 14, and stores it (s8, s9). On the other hand, the bill handing machine 1 carries the bill (the reject bill) judged as the non-receivable bill in the judging portion 6 to a bill accommodating space (hereinafter, refer to as a reject bill accommodating space) between the first pusher plate 12 and the second pusher 13, and stores it (s8, s10). The bill handling machine 1 repeatedly executes the processes s6 to s9 with respect to all the bills input to the bill input space (s11). In other words, the bill processing device 1 executes the judgment of all the bills input to the bill input space. At this time, since the second pusher plate 13 and the third pusher plate 14 exist at the initial position, the bill (the received bill) carried to the inner side of the temporary storage space by the carrying roller of the separating and feeding/stack mechanism 5 is piled on the upper surface of the second pusher plate 13. Further, since the first pusher plate 12 moves to the receiving plate 11 side for feeding the bill input to the bill input space, the bill (the reject bill) carried to the inner side of the reject bill storage space by the carrying roller of the stack mechanism 4 is piled on the upper surface of the first pusher plate 12.

If the bill handling machine 1 finishes the judgment of all the bills input to the bill input space, and stores the bills in the temporary storage space or the reject bill accommodating space on the basis of the judged result, the bill handling machine 1 judges whether or not the reject bill is accommodated in the reject bill accommodating space (s12), and if the reject bill is accommodated in the reject bill accommodating space, the bill handling machine 1 opens the shutter 2*a* (s13). At this time, the first pusher plate 12 is brought into contact with the receiving plate 11, one end portion thereof exists at a position which is approximately along the lower end line of the money input and output port 2, and one end portion of the second pusher plate 13 exists at a position which is approximately along the upper end line of the money input and output port 2 (refer to FIG. 6). Accordingly, since the shutter 2*a* is opened by the step s12, the user can take out the bill accommodated in the reject bill accommodating space facing to the money input and output port 2. As mentioned above, the bill handling machine 1 can bring back the reject bill to the user by opening the shutter 2*a*.

If the reject bill accommodated in the reject bill accommodating space is taken out by the user (s14), the bill handling machine 1 closes the shutter 2*a* (s15). In the case that the bill handling machine 1 judges in the step s11 that the reject bill is not accommodated in the reject bill accommodating space, or closes the shutter 2*a* in the step s15, the bill handling machine 1 waits for an input about any one of a confirmation of the input money amount, a demand of an additional input, a demand of a cancel of the money input account (s16 to s18). If the input about the additional input of the bill is executed, the bill handling machine 1 returns the first pusher plate 12 to the original position (s19), and returns to the step s2 so as to repeat the processes mentioned above. At this time, the second pusher plate 13 and the third pusher plate 14 exist at the original position.

Further, if the input about the confirmation of the input money account is executed, the bill handling machine 1 changes the process from the input money counting process mentioned above to the input money accommodating process. First, the bill handling machine 1 moves the second pusher plate 13 to the third pusher plate 14 side, and presses the received bill accommodated in the temporary storage space to the feeding/carrying roller 5 (s20) (refer to FIG. 7). As mentioned above, it is possible to press the bill accommodated in the temporary storage space to the feeding roller of the separating and feeding/stack mechanism 5 by the second pusher plate 12 on the basis of a suitable pressing force. The bill handling machine 1 rotates the feeding roller of the separating and feeding/stack mechanism 5, feeds the received bills accommodated in the temporary storage space one by one (s21), carries the fed bill to the judging portion 6, and judges again whether or not the bill corresponds to the receivable bill (s22). The bill handling machine 1 carries the bill which is judged as the receivable bill in accordance with the re-judgment in the judging portion 6 to the corresponding bill cartridges 7*a* to the bill kinds, and accommodates (s23, s24). Further, the bill handling machine 1 carries the bill which is judged as the non-receivable bill in accordance with the re-judgment to the recovery cartridge 8, and accommodates (s23, s25). The bill handling machine 1 repeats the processes s21 to s25 until all the received bills accommodated in the temporary storage space are accommodated in the bill cartridges 7*a* to 7*c* or the recovery cartridge 8 (s26). If the bill handling machine 1 accommodates all the received bills accommodated in the temporary storage space in the bill cartridges 7*a* to 7*c* or the recovery cartridge 8, the bill handling machine 1 executes the money input process in correspondence to the input money at this time (s27), and finishes the present process.

Further, if the input about the cancel of the money input account is applied, the bill handling machine 1 moves the second pusher plate 13 to the receiving plate 11 by the second actuator 24 (s28). At this time, the first pusher plate 12 is brought into contact with the receiving plate 11. Accordingly, the second pusher plate 13 can be moved to a position where the second pusher plate 13 is brought into contact with the first pusher plate brought into contact with the receiving plate 11. The bill handling machine 1 moves the second pusher plate 13 to a position where the second pusher plate 13 is brought into contact with the first pusher plate 12 brought into contact with the receiving plate 11. Accordingly, one end portion of the third pusher plate 14 coupled to the second pusher plate 13 by the coupling plate 26 moves to a position which is approximately along the upper end line of the of the money input and output port 2 (refer to FIG. 8), and the temporary storage space faces to the money input and output port 2. Thereafter, the bill handling machine 1 opens the shutter 2*a* (s29), if the bill accommodated in the temporary storage space is taken out by the user (s30), the bill handling machine 1 closes the shutter 2*a* (s31), and finishes the present process. In this case, the money input process is not executed.

Figure 5:
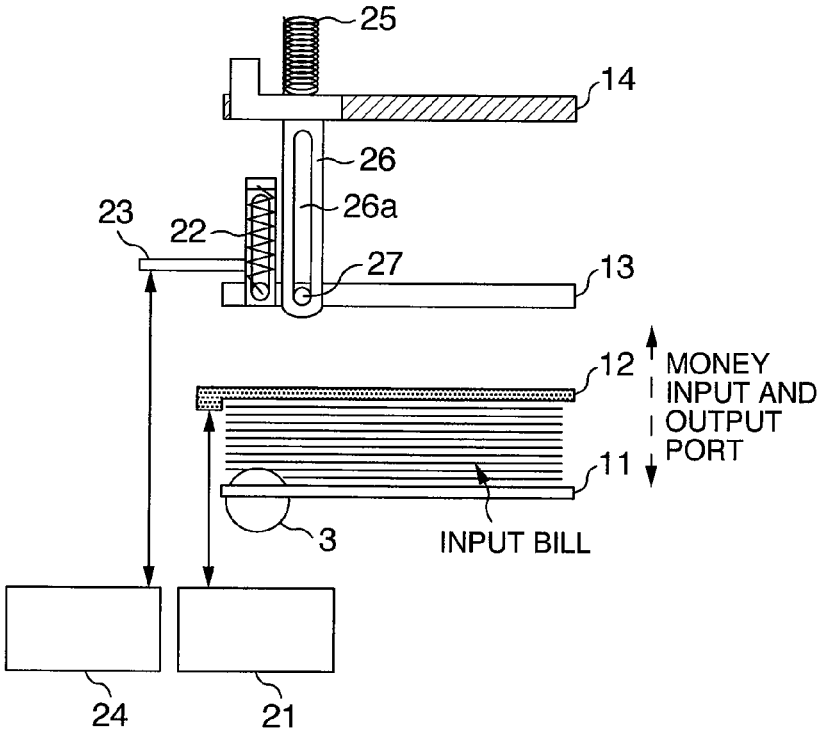
FIG. 5 is a view showing positions of the receiving plate and the first to third pusher plates.
Figure 7:
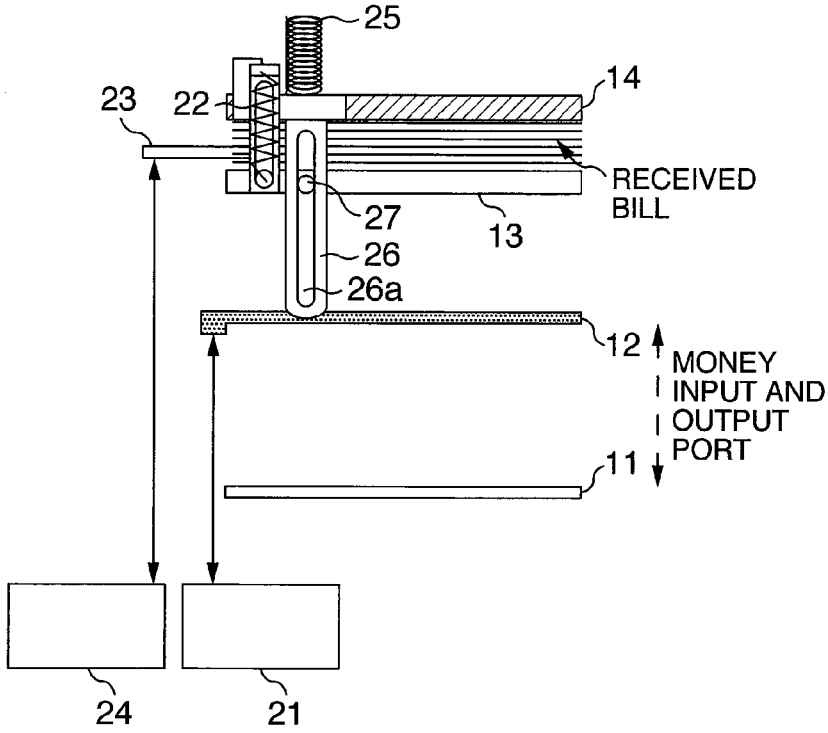
FIG. 7 is a view showing the positions of the receiving plate and the first to third pusher plates.
Figure 9:
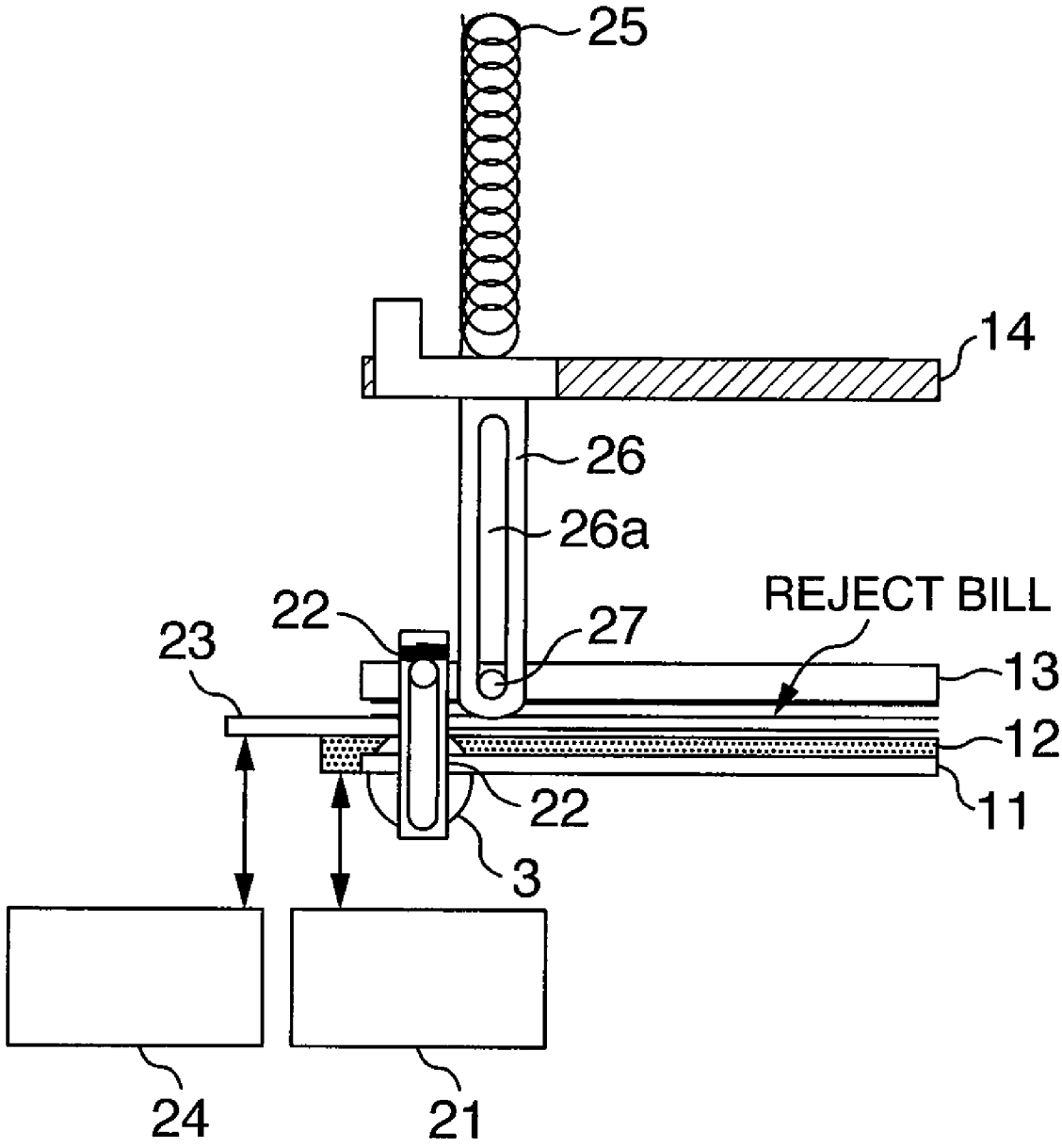
FIG. 9 is a view showing the positions of the receiving plate and the first to third pusher plates.

Further, if the bill which is neglected to be taken by the user is left in any one of the bill input space, the reject bill accommodating space and the temporary storage space after the money input account, the bill handling machine 1 feeds the bill so as to accommodate in the recovery cartridge 8. The bill accommodated in the bill input space is pressed to the feeding roller of the separating and feeding mechanism 3 by the first pusher plate 12 and fed as shown in FIG. 5. Further, the bill accommodated in the temporary storage space is pressed to the feeding roller of the separating and feeding/stack mechanism 5 by the second pusher plate 13 and is fed as shown in FIG. 7. Further, the bill accommodated in the reject bill accommodating space is pressed to the feeding roller of the separating and feeding mechanism 3 and is fed by moving the first pusher plate 12 to the position where the first pusher plate 12 is brought into contact with the receiving plate 11 by the first actuator 21, and moving the second pusher plate 13 to the position where the second pusher plate 13 is brought into contact with the receiving plate 11 by the second actuator 24, as shown in FIG. 9. In this case, the first pusher plate 12 and the second pusher plate 13 form notches at positions facing to the feeding roller of the separating and feeding mechanism 3 as mentioned above, and can press the bill accommodated in the reject bill accommodating space to the feeding roller of the separating and feeding mechanism 3.

As mentioned above, the bill handling machine 1 in accordance with the embodiment can make any one of three spaces divided by four plates comprising the receiving plate 11 and the first to third pusher plates 12 to 14 face to the money input and output port 2. Specifically speaking, it is possible to make the bill input space sectionalized by the receiving plate 11 and the first pusher plate 12 face to the money input and output port 2 at a time of inputting the bill, it is possible to make the reject bill accommodating space sectionalized by the first pusher plate 12 and the second pusher plate 13 face to the money input and output port 2 at a time of bringing back the reject bill, and it is possible to make the temporary storage space sectionalized by the second pusher plate 13 and the third pusher plate 14 and accommodating the receiving bill face to the money input and output port 2 at a time when the money input account is cancelled in the middle (at a time when the customer commands to bring back the counted bill after inputting). Accordingly, it is possible to input the input bill, bring back the reject bill, and bring back the received bill at a time when the money input account is canceled in the middle, by moving the first to third pusher plates 12 to 14, and it is possible to make the machine main body compact. Further, since the structure is made such as to move three pusher plates (the first to third pusher plates 12 to 14) by two actuators (the first actuator 21 and the second actuator 24), it is possible to make the machine more compact, and a cost increased of the machine main body can be sufficiently limited, and can be made inexpensive.

Figure 10:
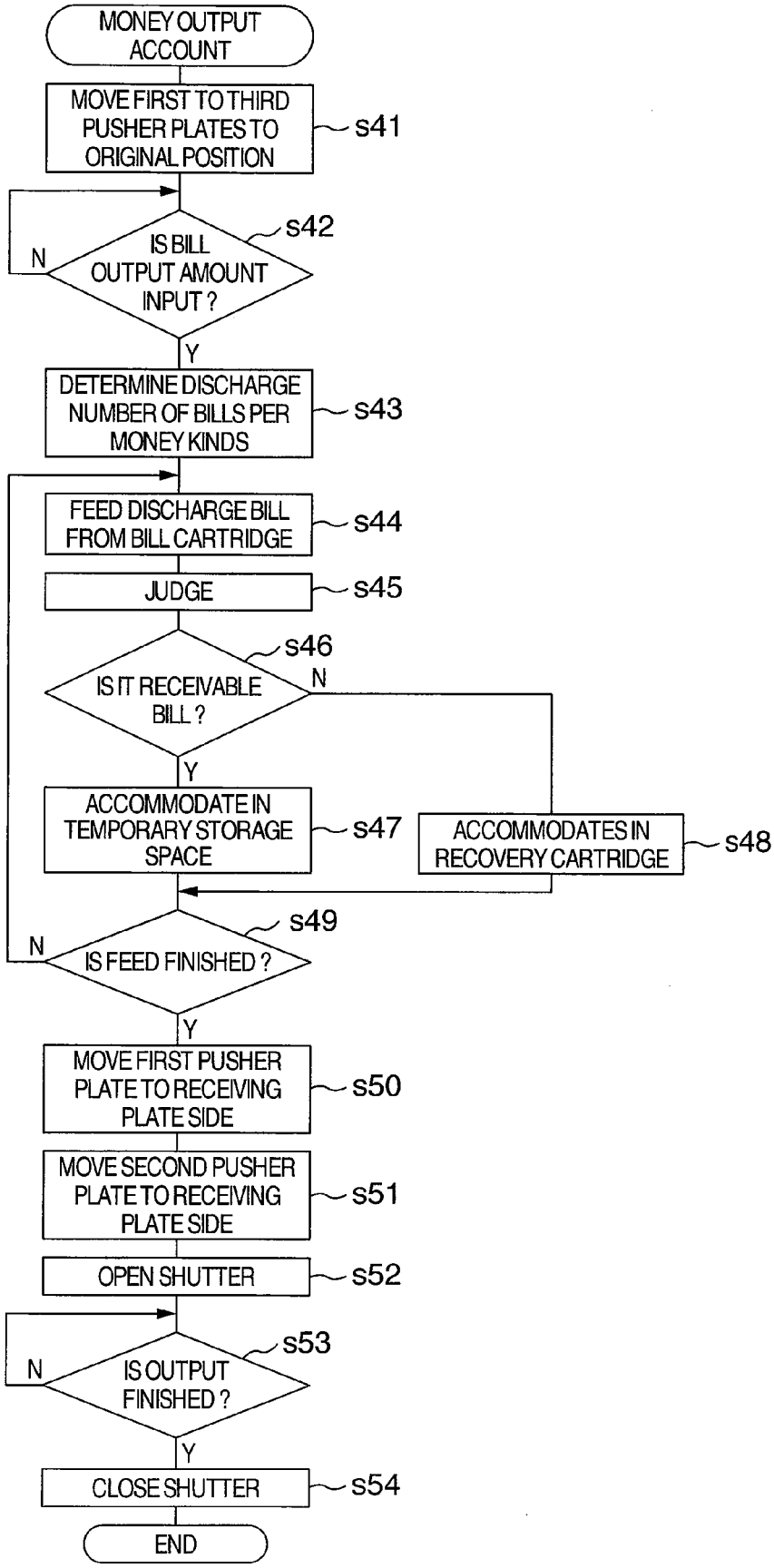
FIG. 10 is a flow chart showing a process at a time of money output account.

Next, a description will be given of an operation of the money output account. FIG. 10 is a flow chart showing a process at a time of the money output account in the bill handling machine in accordance with the embodiment. If the money output account is selected, the bill handling machine 1 starts the process. The bill handling machine 1 moves the first to third pusher plates 12 to 14 to the original position (s41), and receives the input of the output money amount (s42). The bill handling machine 1 determines the output number of the bills per the money kinds on the basis of the input output money amount (s43). The bill handling machine 1 feeds the discharge number of bills determined in the step s43 per the money kinds from the bill cartridges 7*a* to 7*c*, and feeds them to the judging portion 6. In the judging portion 6, there is executed a judgment whether or not the bill corresponds to the receivable bill (s45). The bill handling machine 1 carries the bill judged as the receivable bill in the step s45 to the temporary storage space, and accommodates (s46, s47). On the contrary, the bill handling machine 1 carries the bill judged as the non-receivable bill to the recovery cartridge 8 and accommodates (s46, s48).

Figure 8:
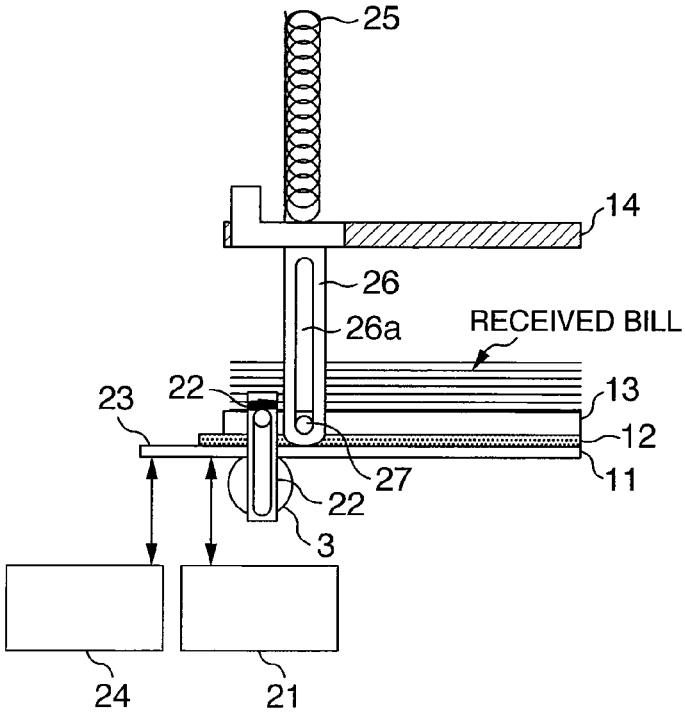
FIG. 8 is a view showing the positions of the receiving plate and the first to third pusher plates.

If the bill handling machine 1 accommodates the bills corresponding to the output money amount input in the step s42 in the temporary storage space, the bill handling machine moves the first pusher plate 12 to the position where the first pusher plate 12 is brought into contact with the receiving plate 1 by the first actuator 21 (s50). Further, the bill handling machine 1 moves the second pusher plate 13 to the position where the second pusher plate 13 is brought into contact with the first pusher plate 12 brought into contact with the receiving plate 11 by the second actuator 24 (s51). Accordingly, as shown in FIG. 8, the temporarily storage space faces to the money input and output port 2. The bill handling machine 1 opens the shutter 2*a* in this state (s52), and if the bill accommodated in the temporary storage space is taken out by the user (s53), the bill handling machine 1 closes the shutter 2*a* (s54). Further, the bill handling machine 1 executes the money output process in correspondence to the output money amount in the money output account at this time (s55), and finishes the present process.

In this case, if the bill which is neglected to be taken by the user is left in the temporary storage space, the bill handling machine 1 feeds the bill so as to accommodate the recovery cartridge 8.

As mentioned above, no problem is generated in the money output account, it is possible to accommodate the output bill in the temporary storage portion, and it is possible to output to the user.

Next, paying attention to the second pusher plate 13 and the receiving plate 11, a description will be given mainly of shapes thereof. FIGS. 11 and 12 illustrate states of the respective plates in a state in which the shutter 2*a* of the money input and output port 2 is opened.

As shown in FIG. 11, the second pusher plate 13 is provided with neither hole nor notch, and is provided with a bag-shaped concave shape 28 in the center. Further, the receiving plate 11 is provided with a concave shape 29, which is formed such as to be just fitted at a time when the second pusher plate 13 is brought into contact with the receiving plate 11, as shown in FIG. 15. FIG. 11 is used for showing the states of the respective plates 11, 12 and 13, however, this layout is not formed in the actual money input and output accounts.

FIG. 12 shows a state in which the second pusher plate 13 is brought into contact with the receiving plate 11, and the shutter 2*a* is in the open state. This state is formed at a time when the input bill is brought back or the output bill is output, and the bill piled on the second pusher plate 13 is taken out by the customer, as shown in FIG. 14. As mentioned above, when the bill is taken out at a time of the money output account or the cancel of the input money, the second pusher plate 13 moved to the position where the second pusher plate 13 is brought into contact with the receiving plate 11, and there is generated the state in which the bill is put on thereon. At this time, it is possible to easily insert the finger to the concave portion of the second pusher plate 13 so as to hold and take out the bill on the plate, and it is possible to easily insert the hand because the space becomes wide at an amount of the concave portion. Further, since the concave portion of the second pusher plate 13 is fitted to the concave portion of the receiving plate 11, the finger of the user does not enter into the portion between the plates.

Figure 6:
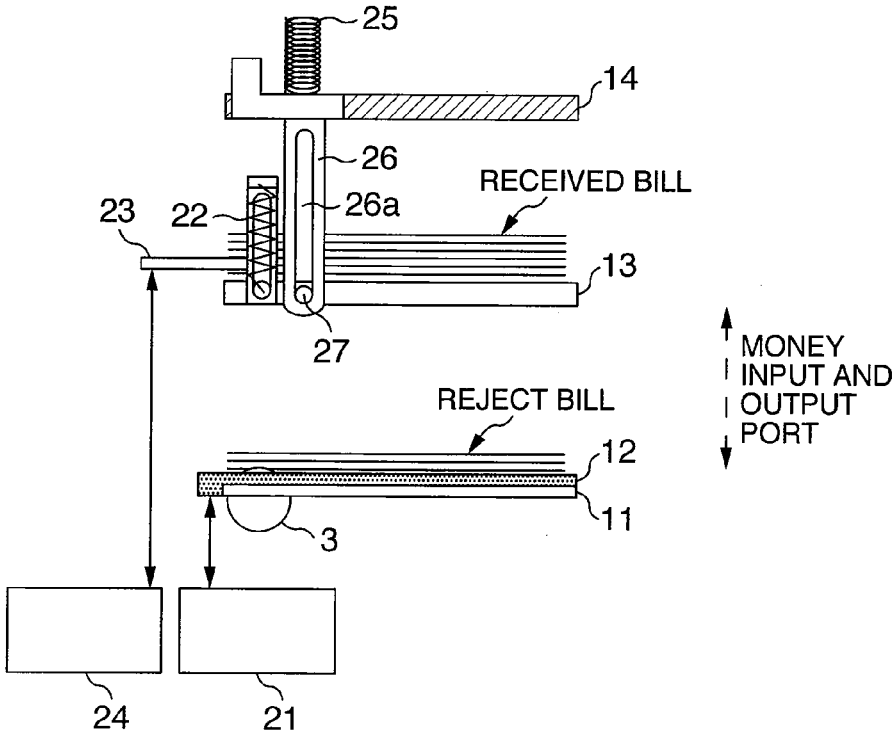
FIG. 6 is a view showing the positions of the receiving plate and the first to third pusher plates.

FIG. 13 illustrates a state in which the reject bill is generated in the money input account. Since the plate 12 is stopped near the center of the input and output port 2, the customer easily becomes aware of the existence of the reject bill. In this case, as shown in FIG. 6 mentioned above, the plates 11 and 12 may be in the state in which they are brought into contact with each other. In the case that the reject bill is brought back, the shutter 2*a* is opened in a state in which the bill exists in the temporary storage (the temporary storage portion). At this time, the second pusher plate 13 exists at a position which is along the upper end line of the money input and output port, and is in the state in which the bill is put thereon. As explained in FIG. 11 and the like, since no hole and notch exists in the second pusher plate 13, the user can not access the received bill on the plate from the money input and output port side. In other words, the second pusher plate 13 is formed in such a shape as to be isolated from the accommodating portion accommodating the input bill or the accommodating portion accommodating the reject bill. In this case, there can be considered a structure in which the bill on the plate is easily held by forming the notch or the like in the plate 13, however, there is generated a problem that the user can access the received bill stored in the temporary storage portion from the money input and output side at that time. Accordingly, as the structure by which the user can not access the temporary storage portion and can easily hold the bill, there is provided the structure in which the plate 13 is formed in an approximately rectangular shape with no notch and the concave shape 28 is provided in the center thereof, as shown in FIGS. 11, 15 and the like.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A bill handling machine comprising:

a money input and output port inputting and outputting a bill;

a shutter opening and closing said money input and output port;

a judging portion judging the bill;

a money kind box accommodating the bill per money kinds; and a control portion, wherein a bill accommodating space closer to an inner side than said shutter is divided into a first bill accommodating portion of the input bill put in from said money input and output port, a third bill accommodating portion temporarily storing the input bill which is fed from said first bill accommodating portion and is judged as a receivable bill by said judging portion and accommodating the output bill which is output from said money kind box, and a second bill accommodating portion provided between said first bill accommodating portion and said third bill accommodating portion and accommodating a reject bill fed from said first bill accommodating portion and judged as a bill which is not an acceptable bill by said judging portion, wherein said first bill accommodating portion, said second bill accommodating portion and said third bill accommodating portion are divided by a first plate, a second plate and a third plate which are movable with respect to each other, said first bill accommodating portion is formed between said first plate and a receiving plate, said second bill accommodating portion is formed between said first plate and said second plate, said third bill accommodating portion is formed between said second plate and said third plate, and the control portion carries out an adjustment of an accommodating space size or a position of said first bill accommodating portion, said second bill accommodating portion and said third bill accommodating portion, by moving said first plate, said second plate and said third plate, and wherein said third bill accommodating portion is provided with a separating and feeding/stack mechanism for feeding the bill from said third bill accommodating portion or for accommodating the bill in said third bill accommodating portion.

2. The bill handling machine of claim 1, wherein said third bill accommodating portion is arranged in an upper side of said first accommodating portion.

3. The bill handling machine of claim 1, wherein said control portion controls so as to carry the output bill output from said money kind box to said third bill accommodating portion via said judging portion.

4. The bill handling machine of claim 1, wherein said control portion judges the bill put in said first bill accommodating portion by said judging portion so as to pile and accommodate in said third bill accommodating portion, and moves said third bill accommodating portion to an accommodating space formed by the first bill accommodating portion at a time when a command of bringing back said input bill is generated.

5. The bill handling machine of claim 3, wherein said control portion moves said third bill accommodating portion to an accommodating space formed by said first bill accommodating portion.

6. The bill handling machine of claim 1, wherein said second plate has a concave shape in a part of the plate close to the money input and output port, and has a space between said bill and the portion having the concave shape in said second plate, in a state in which the bill is put on said second plate.

7. The bill handling machine of claim 6, wherein said receiving plate has a concave shape in a part of the plate, and said concave shape of said second plate is fitted to said concave shape of said receiving plate at a time when said first plate and the second plate come into contact with said receiving plate.

8. The bill handling machine of claim 1, wherein said first plate and said second plate are driven by two different actuators.

9. The bill handling machine of claim 1, wherein the bill stored in said third bill accommodating portion can be taken out from said money input and output port.

10. The bill handling machine of claim 1, wherein said third bill accommodating portion accommodates the output bill output from said money kind box.

* * * * *